United States Patent [19]

Joslyn

[11] 4,221,955

[45] Sep. 9, 1980

[54] DEMAND REGULATED ELECTRODE-TYPE STEAM GENERATOR

[75] Inventor: Larry J. Joslyn, Walworth, N.Y.

[73] Assignee: Sybron Corporation, Rochester, N.Y.

[21] Appl. No.: 935,347

[22] Filed: Aug. 21, 1978

[51] Int. Cl.[2] ..... H05B 3/60; F22B 1/30

[52] U.S. Cl. ..... 219/287; 219/273; 219/295; 338/86

[58] Field of Search ..... 219/284–295, 219/271–276; 338/80–86

[56] References Cited

U.S. PATENT DOCUMENTS

| | | | |
|---|---|---|---|
| 1,462,350 | 7/1923 | Merrill et al. | 219/286 |
| 1,650,632 | 11/1927 | Kowallik | 219/286 |
| 1,665,793 | 4/1928 | Sandborgh | 219/286 |
| 1,885,373 | 11/1932 | Planche | 338/86 X |
| 2,447,294 | 8/1948 | Vickery | 219/291 X |
| 3,761,679 | 9/1973 | Dall | 219/286 X |

FOREIGN PATENT DOCUMENTS

| | | | |
|---|---|---|---|
| 785775 | 5/1935 | France | 219/290 |
| 927341 | 4/1947 | France | 219/284 |
| 505035 | 4/1976 | U.S.S.R. | 338/86 |

*Primary Examiner*—A. Bartis

*Attorney, Agent, or Firm*—Theodore B. Roessel; Roger Aceto

[57] ABSTRACT

An electrode-type steam generator includes a pair of spaced electrodes extending into a pressure vessel having a feed water inlet and a steam outlet. A rotary stirring device, cycled on and off by a pressure switch in the steam outlet, is provided in the vessel below the electrodes and is operative to create a vortex which artificially raises the level of the water adjacent the sides of the vessel without water being added, whereby the electrodes are immersed to a greater extent when the stirrer is operating to increase steam production than when it is not operating. The flow of water into the vessel through the feed water inlet is controlled by a solenoid valve responsive to the current flow between the immersed portions of the electrodes. A pressure operated valve is provided in the feed water inlet upstream of the solenoid valve for overriding operation of the solenoid valve if the pressure in the vessel exceeds a predetermined value, the predetermined value being lower than the pressure at which the pressure switch is operative to cycle the stirrer on and off.

2 Claims, 1 Drawing Figure

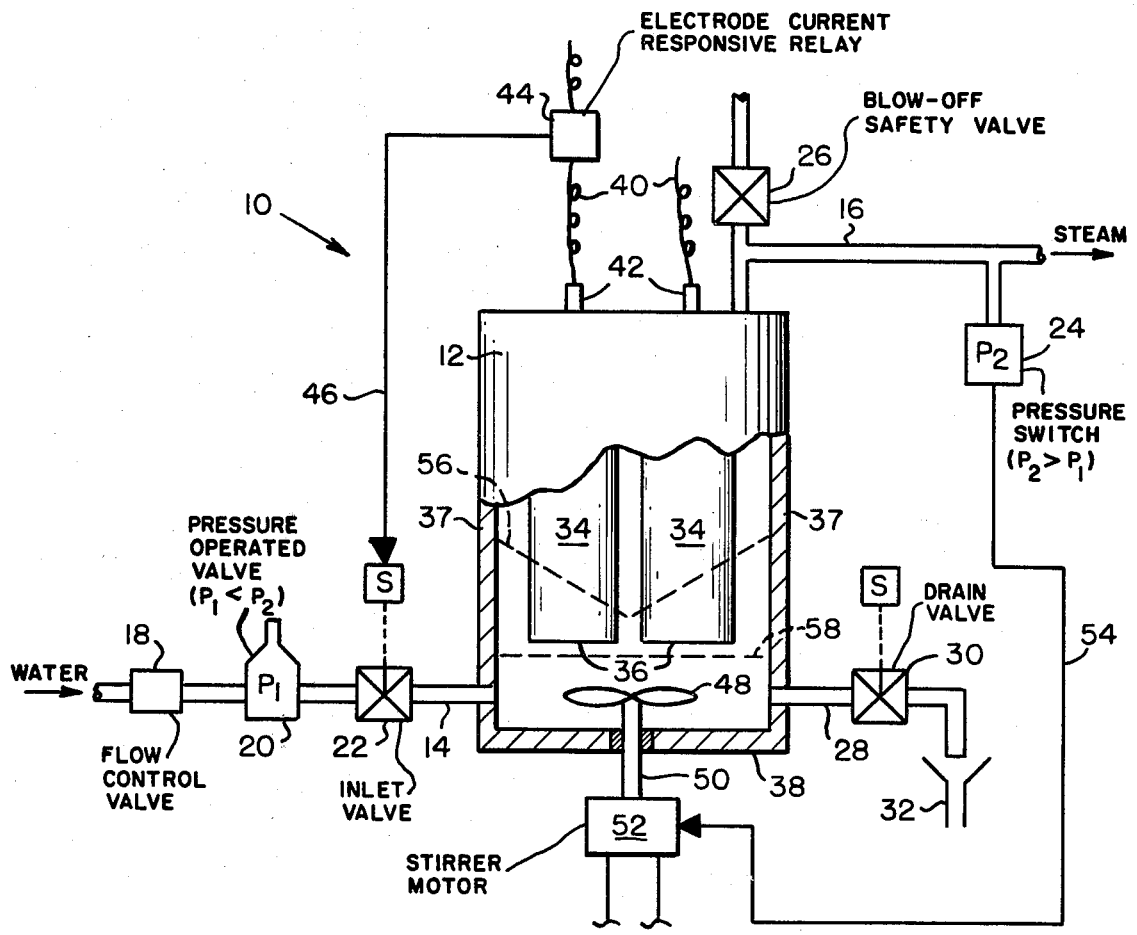
ELECTRODE CURRENT RESPONSIVE RELAY
44
BLOW-OFF SAFETY VALVE
26
40
10
16
STEAM
42
24
12
P2
46
PRESSURE SWITCH ($P_2 > P_1$)
56
37
34
34
37
PRESSURE OPERATED VALVE ($P_1 < P_2$)
S
S
DRAIN VALVE
18
58
54
WATER
P1
36
48
30
20
22
14
28
FLOW CONTROL VALVE
INLET VALVE
50
38
32
52
STIRRER MOTOR

DEMAND REGULATED ELECTRODE-TYPE STEAM GENERATOR

TECHNICAL FIELD

The present invention relates to steam generators and more specifically to a method and apparatus for regulating the production of steam responsive to demand.

SUMMARY OF THE INVENTION

In the present invention, a steam generator that uses immersed electrodes for boiling the water is equipped with a stirring mechanism. As the stirrer operates, it circulates the water creating a vortex and raising the level of water adjacent the walls of the generator so as to immerse the heating electrodes. Any change in steam demand creates a proportionate but inverse pressure change in the steam generator. As the pressure rises in the generator (reduced steam demand) the stirrer is shut off, dropping the water level below the electrodes. As the pressure within the steam generator drops (increased steam demand) the stirrer is activated to again raise the liquid level and immerse the electrodes.

DESCRIPTION OF THE DRAWINGS

The sole FIGURE is a schematic representation of the steam generator of the present invention, partly broken away and in section.

DETAILED DESCRIPTION OF THE INVENTION

Referring to the drawings, the steam generator of the present invention is generally indicated at 10 and includes a pressure vessel 12 having a water inlet 14 and a steam outlet 16. The flow of water through inlet 14 into the vessel is controlled by a flow control valve 18, a pressure operated valve 20 and a solenoid valve 22. The pressure of steam leaving through steam outlet 16 is sensed by a pressure switch 24. A safty valve 26 located in steam outlet 16 upstream of the pressure switch provides for the blow-off of steam should the pressure within vessel 12 exceed a predetermined value.

In addition to the water inlet 14 and the steam outlet 16, there is a water discharge pipe 28, which is used to flush pressure vessel 12 at periodic intervals. A solenoid valve 30 controls flow of water through the outlet pipe 28 to a drain 32.

Located within vessel 12 are immersion heating electrodes 34. These electrodes lie adjacent the side wall 37 of the vessel and the lower end 36 of each electrode terminates at some distance above the bottom 38 of vessel 12. Immersion heating electrodes 34 are suspended in vessel 12 and draw their power from a source not shown through electrical lines 40 and electrical connectors 42 extending through the top of vessel 12. A current control relay 44 in the circuit to the electrodes is operatively connected to solenoid valve 22 through a line 46 for purposes of opening and closing the solenoid valve 22 responsive to a predetermined current flow. When current through the electrodes exceeds a predetermined level, solenoid valve 22 will close and when the current falls below a predetermined value, the solenoid valve will open.

Disposed within vessel 12 adjacent its bottom 38 is a stirring device or agitator 48. Agitator 48 is connected to one end of a drive shaft 50 which extends through the bottom of vessel 12. This drive shaft is driven by any suitable means located outside of the vessel, such as an electric motor 52. While motor 52 receives power from a source not shown it can be turned "on" or "off" by a signal from pressure switch 24 acting through line 54. In this respect the motor is turned "off" at a predetermined high pressure and is turned "on" at a predetermined low pressure.

In operation, energizing the control circuit (not shown) of the steam generator permits the feed water to enter vessel 12 through flow control valve 18, pressure operated valve 20 and solenoid valve 22. Either simultaneously with the entry of water into vessel 12 or after an appropriate delay, motor 52 is started to drive agitator 48. Rotation of the agitator drives the water in a circular path with sufficient velocity to form a conical vortex shaped water surface as indicated at 56. As the water rises adjacent the vessel wall 37 and begins to immerse electrodes 34, current begins to flow through the electrodes to heat the water. Current flow increases as the water level rises on the electrode until a predetermined current is reached. At this point, current control relay 44 issues a signal through line 46 to close solenoid valve 22.

As steam is delivered from the steam generator through outlet 16, the water level within vessel 12 drops. As the water level drops and exposes more of electrodes 34, current flow also decreases. This occurs until such time as the current flow falls below a predetermined level at which point current control relay 44 operates to open solenoid valve 22 to introduce more feed water into vessel 12. The current control relay 44 continues to modulate the water supply and therefore the water level within the vessel by opening and closing solenoid valve 22 in this fashion as long as there is a steam demand.

Should the demand for steam decrease, the pressure within vessel 12 begins to increase. As the pressure first rises above a first given level, pressure P1, pressure operated valve 20 closes to prevent supply water from entering vessel 12. Pressure operated valve 20, being upstream from solenoid valve 22 thus overrides the solenoid valve in controlling flow of water into vessel 12. Should the pressure within vessel 12 continue to rise, pressure switch 24 will eventually issue a signal through line 54 to turn motor 52 off. This occurs at some given pressure, P2 higher than pressure P1.

With motor 52 off, agitator 48 stops. This causes the level of water within the vessel to drop to a second level shown in dotted line at 58. If this second level is below the lower end 36 of electrodes 34, current flow stops and no steam is generated. If however, this level does cover a portion of electrodes 34 there will be minimal current flow and some steam generation. In any event, turning off motor 52 to stop agitator 48 reduces the amount of steam being generated. Should the pressure in vessel 12 still continue to rise, safty valve 26 will open to discharge steam to atmosphere. However, in the usual case the termination or reduced level of steam generation caused by stopping the agitator will allow the pressure within the vessel 12 to drop.

When the pressure in vessel 12 falls below pressure P2, pressure switch 24 will operate to turn on motor 52 so as to again establish a higher water level and increase steam production. Motor 52 and agitator 48 will modulate on and off in this manner until some of the boiler water is discharged as steam. During this time the pressure within vessel 12 should remain above pressure P1 so pressure operated valve 20 remains closed to prevent feed water from entering the vessel.

After a sufficient amount of water has been discharged as steam, the pressure in vessel 12 will gradually fall and stay below pressure P2. At this point motor 52 will remain on, but the pressure will continue to gradually decrease as less and less steam is generated. When the pressure within vessel 12 falls below pressure P1, pressure regulator operated valve 20 will again open to readmit feed water to vessel 12. As the water level in vessel 12 rises and immerses more and more of electrodes 34, the electrode current and the amount of steam being generated also increases. Consequently, the pressure in chamber 12 begins to rise and when it is above pressure P1, pressure operated valve 20 will again close to terminate the introduction of feed water. Accordingly, during this phase of operation the water supply will modulate relative to the pressure setting of pressure operated valve 20.

Should the demand for steam increase, the pressure in vessel 12 will drop. As this level drops below the setting of pressure operated valve 20, the pressure operated valve will remain open and the level of water within vessel 12 wil again be controlled by current control relay 44 and solenoid valve 22 as set out hereinabove.

As the concentration of impurities in the water within vessel 12 increases, it becomes necessary to discharge the contents of vessel 12. This can be accomplished by operation of solenoid 30 which opens outlet 28 to permit the contents of the vessel to discharge to drain 32.

Thus, it should be appreciated that the present invention provides a steam generator in which the production of steam is controlled in part by the use of a stirring device or agitator 18. With the agitator, the level of water in the steam generator can be raised or lowered without actually admitting or removing any water. In addition, operation of the agitator can be used to increase or decrease the amount of steam being generated. In this respect, operation of the agitator to raise the level of water on the immersion heating electrodes 34 increases both current flow and the generation of the steam, whereas stopping the agitator lowers the water level and decreases the amount of steam being generated.

Having thus, described the invention in detail, what is claimed as new is:

1. A steam generator comprising:

(a) a pressure vessel having a feed water inlet and a steam outlet;

(b) a pair of immersion heating electrodes extending into said vessel, said electrodes extending adjacent the sides of said vessel and being spaced above the bottom thereof;

(c) stirring means in said pressure vessel adjacent the bottom thereof and vertically spaced below said heater electrodes for driving the water in the vessel through a circular path of travel with sufficient velocity to raise the level of the water adjacent the sides of the vessel up to said heating electrodes whereby more of said heating electrodes is immersed when said stirring means is operating than and when said stirring means is not operating;

(d) a pressure switch connected to said stirring means and acting responsive to the pressure in said steam outlet being below or above a to steam outlet first predetermined pressure and to respectively start or stop said stirring means;

(e) water level control means including a valve in said feed water inlet acting responsive to current flow through said heating electrodes to open or close said feed water inlet; and (f) a pressure operated valve in said feed water inlet upstream from said valve, said pressure operated valve being adapted to open or close said feed water inlet responsive to the pressure in said pressure vessel being below a second predetermined pressure, said second predetermined pressure being lower than said first predetermined pressure in said steam outlet.

2. In a steam generator including a pressure vessel having a feed water inlet, a steam outlet and employing immersion heating electrodes spaced above the bottom of said vessel and adjacent the sides thereof for boiling the water in said vessel, a method of controlling steam production comprising the steps of:

(a) driving the water in said pressure vessel in a circular motion with sufficient velocity to raise the water level adjacent the sides of said vessel an amount sufficient to immerse at least a portion of said electrodes in the water;

(b) stopping or starting the circular movement of the water in said vessel responsive to the pressure of steam at said steam outlet being respectively above or below a first predetermined pressure;

(c) controlling the water level in said pressure vessel by opening or closing said feed water inlet responsive to current flow through said immersion heating electrodes being respectively below or above a predetermined value; and (d) overriding step (c) by closing said feed water inlet responsive to the pressure in said vessel exceeding a second predetermined value which is lower than said first predetermined pressure.

* * * * *